US010722001B2

(12) United States Patent
Malo

(10) Patent No.: US 10,722,001 B2
(45) Date of Patent: Jul. 28, 2020

(54) ATHLETIC SHOE ASSEMBLY

(71) Applicant: Jimmy Malo, Oceanside, CA (US)

(72) Inventor: Jimmy Malo, Oceanside, CA (US)

( * ) Notice: Subject to any disclaimer, the term of this patent is extended or adjusted under 35 U.S.C. 154(b) by 228 days.

(21) Appl. No.: 15/919,619

(22) Filed: Mar. 13, 2018

(65) Prior Publication Data

US 2019/0281929 A1 Sep. 19, 2019

(51) Int. Cl.

| | |
|---|---|
| ***A43B 5/02*** | (2006.01) |
| ***A43B 5/00*** | (2006.01) |
| ***A43C 15/16*** | (2006.01) |
| ***A43B 13/14*** | (2006.01) |
| ***A43B 3/00*** | (2006.01) |
| ***A43B 7/00*** | (2006.01) |
| ***A43C 15/02*** | (2006.01) |

(52) U.S. Cl.

CPC ..... *A43C 15/161* (2013.01); *A43B 3/0042* (2013.01); *A43B 3/0052* (2013.01); *A43B 5/02* (2013.01); *A43B 7/00* (2013.01); *A43B 13/146* (2013.01); *A43C 15/02* (2013.01); *A43C 15/167* (2013.01)

(58) Field of Classification Search

CPC ..... A43C 15/00; A43C 15/02; A43C 15/16; A43C 15/161; A43C 15/162; A43C 15/164; A43C 15/165; A43C 15/167; A43C 15/168; A43C 13/04; A43B 5/00; A43B 5/02; A43B 5/12; A43B 3/0052; A43B 3/0042; A43B 21/433; A43B 13/141; A43B 13/26

USPC ..... 36/134, 126, 128, 67 A, 67 D, 8.3

See application file for complete search history.

(56) References Cited

U.S. PATENT DOCUMENTS

| | | | | |
|---|---|---|---|---|
| 2,109,712 A * | 3/1938 | Arthur | A43B 5/12 36/8.3 |
| D168,913 S | 2/1953 | Snyder | |
| 3,354,561 A | 11/1967 | Cameron | |
| 3,680,231 A * | 8/1972 | Dymond | A43B 3/0042 36/59 R |
| 3,707,047 A * | 12/1972 | Nedwick | A43B 3/0042 36/134 |
| 3,744,160 A * | 7/1973 | Dymond | A43B 3/0042 36/114 |
| 3,816,945 A * | 6/1974 | Egtvedt | A43B 3/0042 36/114 |
| 4,748,752 A | 6/1988 | Tanel | |
| 5,392,537 A | 2/1995 | Goldberg | |
| 5,566,478 A | 10/1996 | Forrester | |

(Continued)

FOREIGN PATENT DOCUMENTS

| | | | |
|---|---|---|---|
| DE | 3622844 A1 * | 1/1988 | A43B 21/433 |
| DE | 202016006312 U1 * | 12/2016 | A43B 5/02 |
| GB | 2221140 A * | 1/1990 | A43B 3/0042 |

*Primary Examiner* — Jameson D Collier

(57) ABSTRACT

An athletic shoe assembly for inhibiting knee and ankle injuries during athletic activities includes a shoe that may be worn during athletic activities. A front cleat unit and a back cleat unit are each positioned on the sole for engaging ground during the athletic activities to enhance traction. Each of the front and back cleat units are rotatably coupled to the sole and the shoe is rotatable about a vertical axis extending through the sole and each of the front and back cleat units. Thus, the front cleat unit and back cleat units inhibit knee and ankle injuries during the athletic activities resulting from a stationary foot and a twisting leg.

13 Claims, 4 Drawing Sheets

(56) References Cited

U.S. PATENT DOCUMENTS

| | | | | |
|---|---|---|---|---|
| 5,682,689 | A * | 11/1997 | Walker | A43B 3/0042 36/134 |
| 6,035,559 | A | 3/2000 | Freed et al. | |
| D424,794 | S | 5/2000 | Garcia | |
| 6,701,645 | B1 * | 3/2004 | Forrester | A43B 3/0042 36/126 |
| 6,829,848 | B2 * | 12/2004 | Gallegos | A43B 3/0042 36/103 |
| 7,757,413 | B2 | 7/2010 | Anderson | |
| 8,104,193 | B1 * | 1/2012 | Teteriatnikov | A43B 13/26 36/115 |
| 2002/0088147 | A1 * | 7/2002 | Joo | A43B 3/0042 36/127 |
| 2003/0056394 | A1 * | 3/2003 | Yu | A43B 3/0042 36/8.3 |
| 2007/0051020 | A1 * | 3/2007 | Tajima | A43B 3/0042 36/132 |
| 2010/0311514 | A1 * | 12/2010 | Antolick | A43B 3/0042 473/217 |
| 2012/0225741 | A1 * | 9/2012 | Antolick | A43B 3/0021 473/452 |
| 2012/0227288 | A1 * | 9/2012 | Teteriatnikov | A43B 3/0042 36/136 |

* cited by examiner

ATHLETIC SHOE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shoe devices and more particularly pertains to a new shoe device for inhibiting knee and ankle injuries during athletic activities.

BRIEF SUMMARY OF THE INVENTION

An embodiment of the disclosure meets the needs presented above by generally comprising a shoe that may be worn during athletic activities. A front cleat unit and a back cleat unit are each positioned on the sole for engaging ground during the athletic activities to enhance traction. Each of the front and back cleat units are rotatably coupled to the sole and the shoe is rotatable about a vertical axis extending through the sole and each of the front and back cleat units. Thus, the front cleat unit and back cleat units inhibit knee and ankle injuries during the athletic activities resulting from a stationary foot and a twisting leg.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
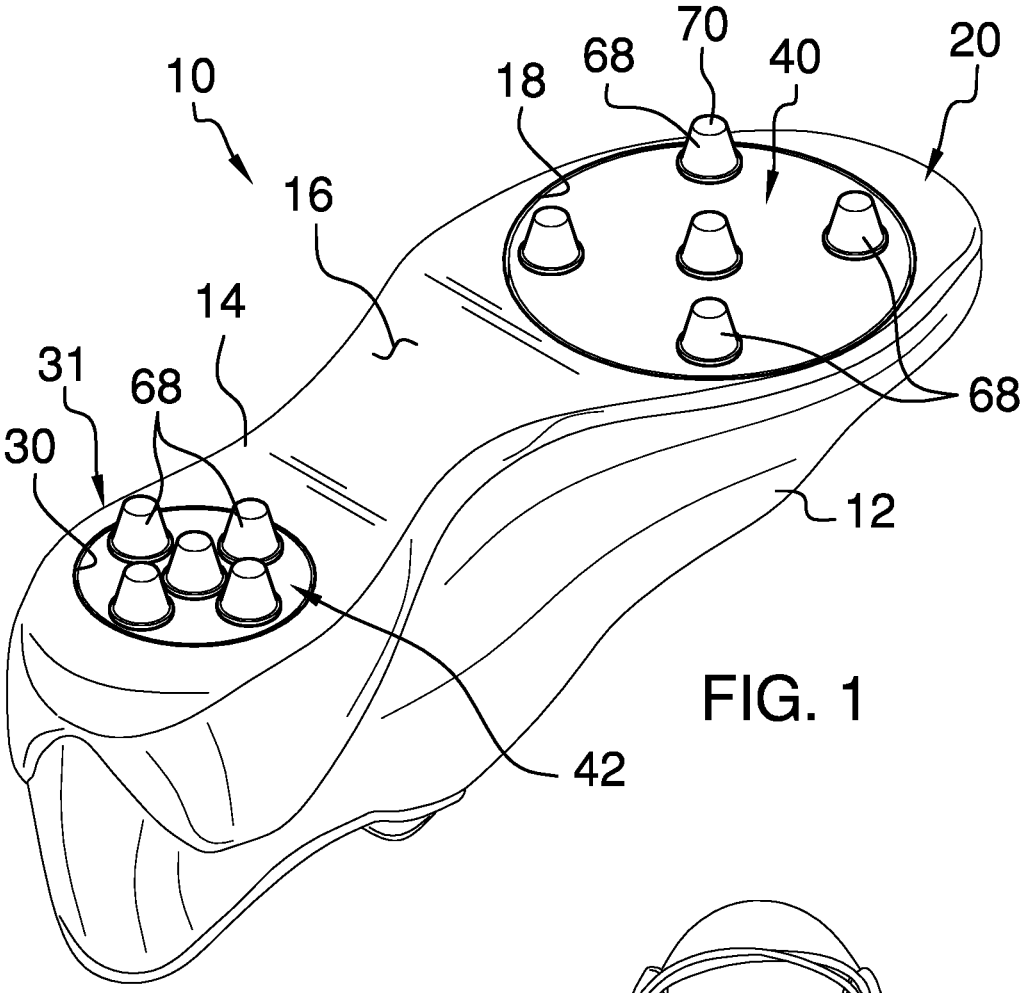
FIG. 1 is a bottom perspective view of an athletic shoe assembly according to an embodiment of the disclosure.
Figure 2:
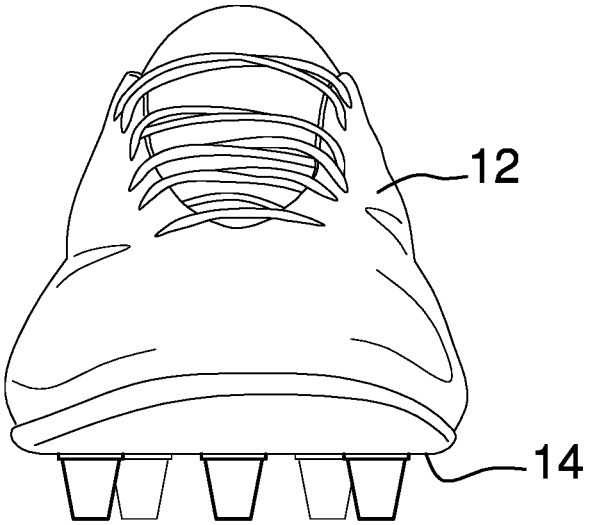
FIG. 2 is a front view of an embodiment of the disclosure.
Figure 3:
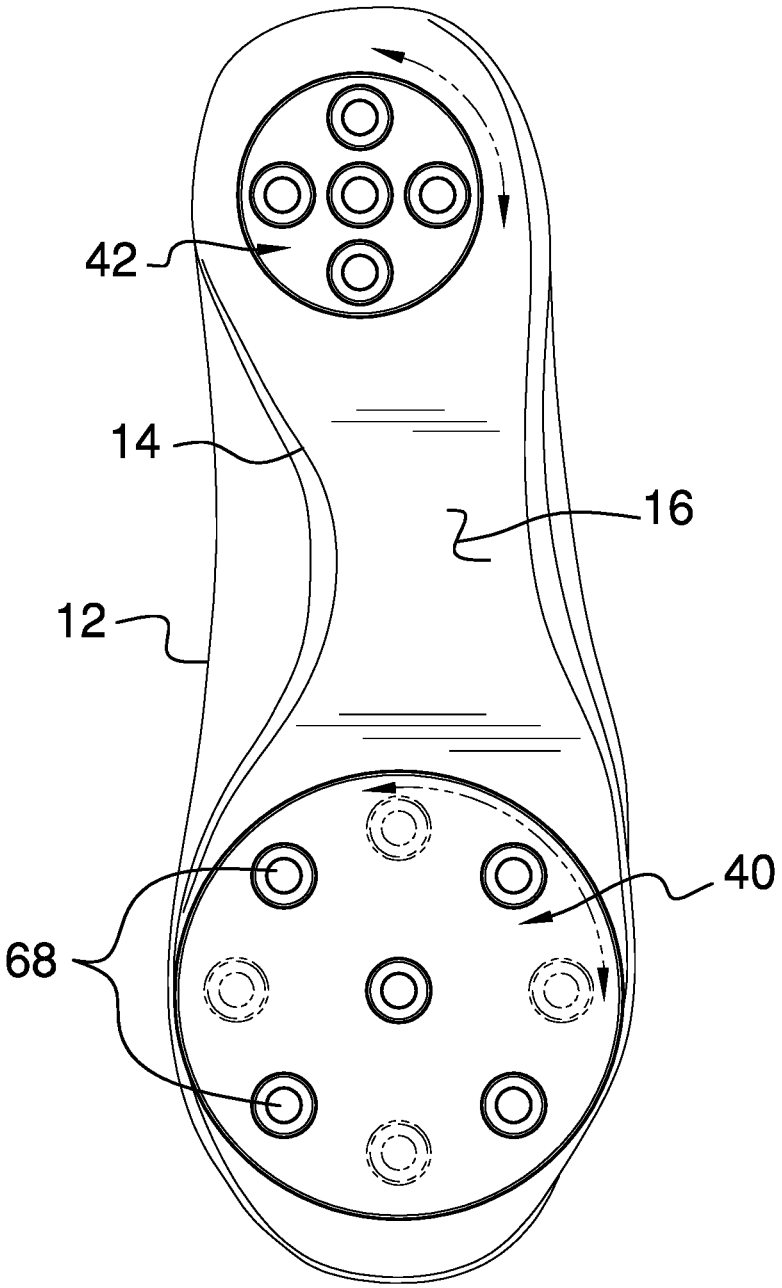
FIG. 3 is a bottom view of an embodiment of the disclosure.
Figure 4:
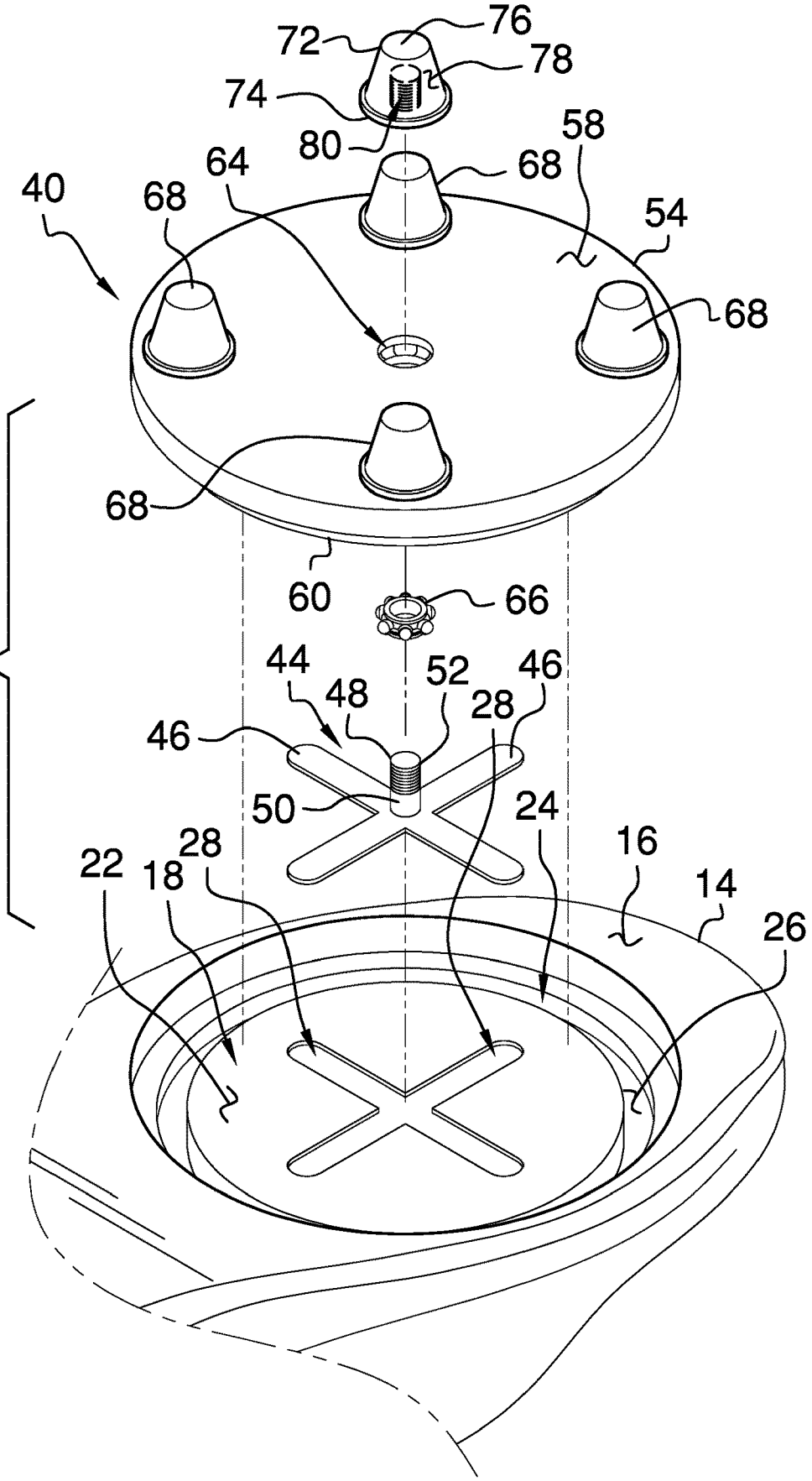
FIG. 4 is an exploded perspective view of an embodiment of the disclosure.
Figure 5:
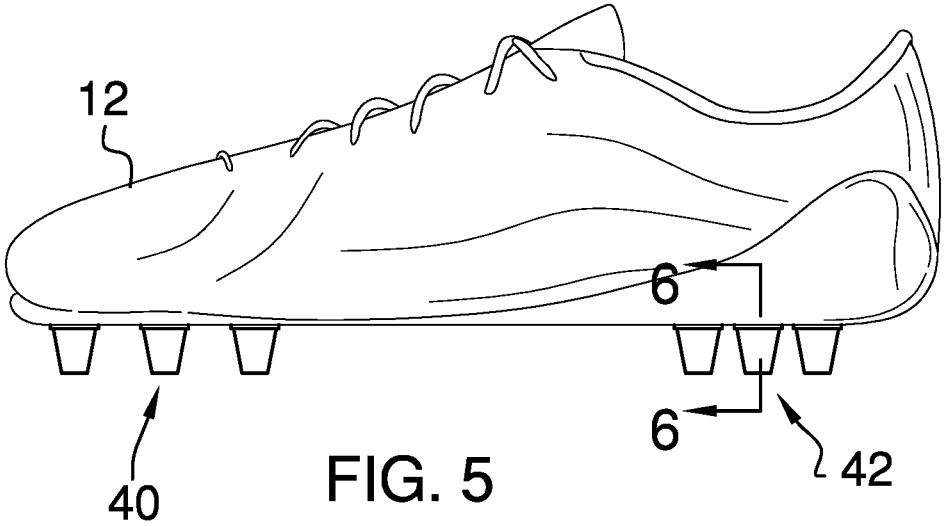
FIG. 5 is a left side view of an embodiment of the disclosure.
Figure 6:
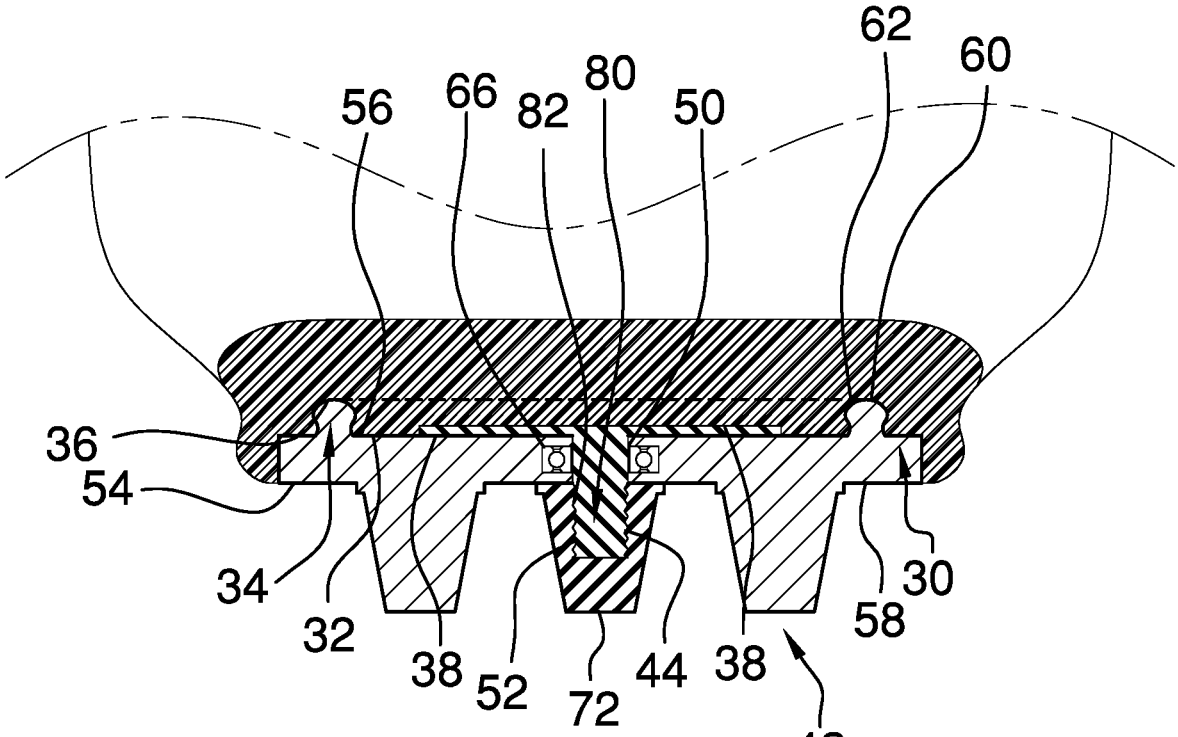
FIG. 6 is a cross sectional view taken along line 6-6 of FIG. 5 of an embodiment of the disclosure.

With reference now to the drawings, and in particular to FIGS. 1 through 6 thereof, a new shoe device embodying the principles and concepts of an embodiment of the disclosure and generally designated by the reference numeral 10 will be described.

As best illustrated in FIGS. 1 through 6, the athletic shoe assembly 10 generally comprises a shoe 12 is configured to be worn during athletic activities. The shoe 12 may be a football shoe, a baseball shoe and any other athletic shoe that commonly has cleats 68. The shoe 12 has a sole 14, the sole 14 has a bottom surface 16 and the bottom surface 16 has a first well 18 extending upwardly therein. The first well 18 is positioned on a toe portion 20 of the sole 14 and the first well 18 has a top bounding surface 22.

The top bounding surface 22 has a first channel 24 extending upwardly therein and the first channel 24 is continuous such that the first channel 24 forms a closed ring. The first channel 24 has a bounding surface 26 and the bounding surface 26 of the first channel 24 is concavely arcuate with respect to the bottom surface 16 of the sole 14. Additionally, the top bounding surface 22 has a pair of first slots 28 extending upwardly. The first slots 28 intersect each other such that the first slots 28 forms a plus shape and the first channel 24 surrounds each of the first slots 28.

The bottom surface 16 has a second well 30 extending upwardly therein and the second well 30 is positioned on a heel portion 31 of the sole 14. The second well 30 has an upper bounding surface 32 and the upper bounding surface 32 has a second channel 34 extending upwardly therein. The second channel 34 is continuous such that the second channel 34 forms a closed ring and the second channel 34 has a bounding surface 36. The bounding surface 36 of the second channel 34 is concavely arcuate with respect to the bottom surface 16 of the sole 14. The upper bounding surface 32 has a pair of second slots 38 extending upwardly therein. The second slots 38 intersect each other such that the second slots 38 forms a plus shape and the second channel 34 surrounds each of the second slots 38.

A front cleat unit 40 is positioned on the sole 14 and the front cleat unit 40 engages ground during the athletic activities to enhance traction. The front cleat unit 40 is rotatably coupled to the sole 14 and the shoe 12 is rotatable about a vertical axis extending through the sole 14, and the front cleat unit 40, when the front cleat unit 40 engages the ground. A back cleat unit 42 is positioned on the sole 14 and the back cleat unit 42 engages ground during the athletic activities to enhance traction. The back cleat unit 42 is rotatably coupled to the sole 14 and the shoe 12 is rotatable about a vertical axis extending through the sole 14 and the back cleat unit 42 when the back cleat unit 42 engages the ground. Thus, each of the front cleat unit 40 and the back cleat unit 42 inhibit knee and ankle injuries during the athletic activities by allowing the shoe 12 to rotate in conjunction with a user's leg even though the front cleat unit 40 or the back cleat unit 42 are firmly engaging the ground.

Each of the front cleat unit 40 and the back cleat unit 42 comprises a retainer 44 that includes a pair of intersecting members 46 and a screw 48 that is coupled to and extends upwardly from the intersecting members 46. Each of the intersecting members 46 corresponding to the front cleat unit 40 are positioned in an associated one of the first slots 28 such that the retainer 44 corresponding to the front cleat unit 40 is inhibited from rotating. Additionally, each of the intersecting members 46 corresponding to the back cleat unit 42 is positioned in an associated one of the second slots 38 such that the retainer 44 corresponding to the back cleat unit 42 is inhibited from rotating. The screw 48 has an un-threaded portion 50 extending upwardly from the intersecting members 46 and a threaded portion 52 extending upwardly from the un-threaded portion 50.

Each of the front cleat unit 40 and the back cleat unit 42 includes a disk 54 that has a first surface 56 and a second surface 58. The first surface 56 has a ridge 60 thereon and the ridge 60 is continuous such that the ridge 60 forms a closed loop. The ridge 60 on the disk 54 corresponding to the front cleat unit 40 is positioned in the first channel 24 and the ridge 60 on the disk 54 corresponding to the back cleat unit 42 is positioned in the second channel 34. Moreover, the ridge 60 has an outer surface 62 and the outer surface 62 is concavely arcuate such that the ridge 60 is rounded. Thus, the ridge 60 on the disk 54 corresponding to the front cleat unit 40 is inhibited from being removed from the first channel 24 and the ridge 60 on the disk 54 corresponding to the back cleat unit 42 is inhibited from being removed from the second channel 34.

The disk 54 has an aperture 64 extending through the first surface 56 and the second surface 58 and the aperture 64 is centrally located on the disk 54. The screw 48 on the retainer 44 extends through the aperture 64 having the disk 54 being aligned with the un-threaded portion 50 of the screw 48. A bearing 66 is positioned in the aperture 64 in the disk 54 and the bearing 66 engages the un-threaded portion 50 of the screw 48 such that the disk 54 is rotatable about the screw 48. The bearing 66 may be a ring bearing or the like and the bearing 66 may be a friction reducing ball bearing or the like.

Each of the front cleat unit 40 and the back cleat unit 42 includes a plurality of cleats 68. Each of the cleats 68 is coupled to the second surface 58 of the disk 54 and each of the cleats 68 engages the ground to enhance traction of the shoe 12. The cleats 68 are spaced apart from each other and are distributed around the disk 54. Each of the cleats 68 has a distal end 70 with respect to the disk 54 and each of the cleats 68 may taper inwardly between the disk 54 and the distal end 70.

Each of the front cleat unit 40 and the back cleat unit 42 include a fastener 72 that has a primary end 74, a secondary end 76 and an outside surface 78 extending therebetween. The primary end 74 has a well 80 extending toward the secondary end 76. The well 80 in the fastener 72 has a bounding surface 82 that is threaded to threadably engage the threaded portion 52 of the screw 48. In this way the fastener 72 releasably retains the disk 54 on the retainer 44. Additionally, the outside surface 78 may taper inwardly between the primary end 74 and the secondary end 76 such that the fastener 72 has a truncated conical shape that is similar to the shape of the cleats 68. A pair of the shoes 12 may be provided and each of the pair of shoes 12 includes all of the aforementioned elements of the front cleat unit 40 and the back cleat unit 42.

In use, the shoes 12 are worn while participating in the athletic activity, such as American football, soccer, baseball and any other sport that generally involves cleats 68. The cleats 68 on each of the front cleat unit 40 and the back cleat unit 42 engage the ground to enhance traction during the athletic activity. The front cleat unit 40 rotates on the sole 14 of the shoe 12 when the user sharply turns direction during running when the user is on the ball of the user's foot. Thus, the shoe 12 is enabled to rotate on the ground when the user's leg twists thereby inhibiting an ankle injury or a knee injury. Alternatively, the rear cleat unit rotates on the sole 14 of the shoe 12 when the user in on the heel of the user's foot. The shoe 12 can rotate when the user is tackled during the game of American football thereby reducing the likelihood of injuries that can result from having a stationary foot and a twisting leg.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An athletic shoe assembly having rotatable cleats thereon wherein said assembly is configured to inhibit knee injuries during athletic activities, said assembly comprising:

a shoe being configured to be worn during athletic activities, said shoe having a sole, said sole having a bottom surface, said bottom surface having a first well extending upwardly therein, said first well being positioned on a toe portion of said sole, said first well having a top bounding surface, said top bounding surface has a first channel extending upwardly therein, said first channel being continuous such that said first channel forms a closed ring, said first channel having a bounding surface, said bounding surface of said first channel being concavely arcuate with respect to said bottom surface of said sole, wherein said top bounding surface has a pair of first slots extending upwardly therein, said first slots intersecting each other such that said first slots form a plus shape, said first channel surrounding each of said first slots;

a front cleat unit being positioned on said sole wherein said front cleat unit is configured to engage a ground during the athletic activities to enhance traction, said front cleat unit being rotatably coupled to said sole, said shoe being rotatable about a first vertical axis extending through said sole and said front cleat unit when said front cleat unit engages the ground wherein said front cleat unit is configured to inhibit knee and ankle injuries during the athletic activities; and a back cleat unit being positioned on said sole wherein said back cleat unit is configured to engage the ground during the athletic activities to enhance traction, said back cleat unit being rotatably coupled to said sole, said shoe being rotatable about a second vertical axis extending through said sole and said back cleat unit when said back cleat unit engages the ground wherein said back cleat unit is configured to inhibit knee and ankle injuries during the athletic activities.

2. The assembly according to claim 1, wherein said bottom surface has a second well extending upwardly therein, said second well being positioned on a heel portion of said sole, said second well having an upper bounding surface.

3. The assembly according to claim 2, wherein said upper bounding surface has a second channel extending upwardly therein, said second channel being continuous such that said second channel forms a closed ring, said second channel having a bounding surface, said bounding surface of said second channel being concavely arcuate with respect to said bottom surface of said sole.

4. The assembly according to claim 3, wherein said upper bounding surface has a pair of second slots extending upwardly therein, said second slots intersecting each other such that said second slots form a plus shape, said second channel surrounding each of said second slots.

5. An athletic shoe assembly having rotatable cleats thereon, wherein said assembly is configured to inhibit knee injuries during athletic activities, said assembly comprising:

a shoe being configured to be worn during athletic activities said shoe having a sole;

a front cleat unit being positioned on said sole, wherein said front cleat unit is configured to engage a ground during the athletic activities to enhance traction, said front cleat unit being rotatably coupled to said sole, said shoe being rotatable about a first vertical axis extending through said sole and said front cleat unit when said front cleat unit engages the ground, wherein said front cleat unit is configured to inhibit knee and ankle injuries during the athletic activities;

a back cleat unit being positioned on said sole, wherein said back cleat unit is configured to engage the ground during the athletic activities to enhance traction, said back cleat unit being rotatably coupled to said sole, said shoe being rotatable about a second vertical axis extending through said sole and said back cleat unit when said back cleat unit engages the ground, wherein said back cleat unit is configured to inhibit knee and ankle injuries during the athletic activities;

said sole of said shoe has a pair of first slots and a pair of second slots; and each of said front cleat unit and said back cleat unit includes a retainer comprising a pair of intersecting members and a screw being coupled to and extending upwardly from said intersecting members, each of said intersecting members corresponding to said front cleat unit being positioned in an associated one of said first slots such that said retainer corresponding to said front cleat unit is inhibited from rotating, each of said intersecting members corresponding to said back cleat unit being positioned in an associated one of said second slots such that said retainer corresponding to said back cleat unit is inhibited from rotating, said screw having an un-threaded portion extending upwardly from said intersecting members and a threaded portion extending upwardly from said un-threaded portion.

6. The assembly according to claim 5, further comprising:

a first channel extending into said sole;

a second channel extending into said sole; and each of said front cleat unit and said back cleat unit including a disk having a first surface and a second surface, said first surface having a ridge thereon, said ridge being continuous such that said ridge forms a closed loop, said ridge on said disk corresponding to said front cleat unit being positioned in said first channel, said ridge on said disk corresponding to said back cleat unit being positioned in said second channel.

7. The assembly according to claim 6, wherein each said ridge has an outer surface, said outer surface being concavely arcuate such that said ridge is rounded, wherein said ridge on said disk corresponding to said front cleat unit is inhibited from being removed from said first channel and said ridge on said disk corresponding to said back cleat unit is inhibited from being removed from said second channel.

8. The assembly according to claim 7, wherein each said disk has an aperture extending through said first surface and said second surface, said aperture being centrally located on said disk, said screw on said retainer extending through said aperture having said disk being aligned with said un-threaded portion of said screw.

9. The assembly according to claim 8, further comprising a respective bearing being positioned in said aperture in each said disk, said bearing engaging said un-threaded portion of said screw such that said disk is rotatable about said screw.

10. The assembly according to claim 9, further comprising a plurality of cleats, each of said cleats being coupled to said second surface of an associated one of said disks, wherein each of said cleats is configured to engage the ground to enhance traction of said shoe, said cleats being spaced apart from each other and being distributed around said associated one of said disks.

11. The assembly according to claim 10, further comprising a fastener having a primary end, a secondary end and an outside surface extending between said primary end and said secondary end, said primary end having a well extending toward said secondary end, said well in said fastener having a bounding surface.

12. The assembly according to claim 11, wherein said bounding surface of said well in said fastener is threaded to threadably engage said threaded portion of said screw of each of said front cleat unit and said back cleat unit thereby retaining said disk on said retainer.

13. An athletic shoe assembly having rotatable cleats thereon wherein said assembly is configured to inhibit knee injuries during athletic activities, said assembly comprising:

a shoe being configured to be worn during athletic activities, said shoe having a sole, said sole having a bottom surface, said bottom surface having a first well extending upwardly therein, said first well being positioned on a toe portion of said sole, said first well having a top bounding surface, said top bounding surface having a first channel extending upwardly therein, said first channel being continuous such that said first channel forms a closed ring, said first channel having a bounding surface, said bounding surface of said first channel being concavely arcuate with respect to said bottom surface of said sole, said top bounding surface having a pair of first slots extending upwardly therein, said first slots intersecting each other such that said first slots form a plus shape, said first channel surrounding each of said first slots, said bottom surface having a second well extending upwardly therein, said second well being positioned on a heel portion of said sole, said second well having an upper bounding surface, said upper bounding surface having a second channel extending upwardly therein, said second channel being continuous such that said second channel forms a closed ring, said second channel having a bounding surface, said bounding surface of said second channel being concavely arcuate with respect to said bottom surface of said sole, said upper bounding surface having a pair of second slots extending upwardly therein, said second slots intersecting each other such that said second slots form a plus shape, said second channel surrounding each of said second slots;

a front cleat unit being positioned on said sole, wherein said front cleat unit is configured to engage a ground during the athletic activities to enhance traction, said front cleat being rotatably coupled to said sole, said shoe being rotatable about a first vertical axis extending through said sole and said front cleat unit when said front cleat unit engages the ground, wherein said front cleat unit is configured to inhibit knee and ankle injuries during the athletic activities; and a back cleat unit being positioned on said sole wherein said back cleat unit is configured to engage the ground during the athletic activities to enhance traction, said back cleat unit being rotatably coupled to said sole, said shoe being rotatable about a second vertical axis extending through said sole and said back cleat unit when said back cleat unit engages the ground wherein said back cleat unit is configured to inhibit knee and ankle injuries during the athletic activities, each of said front cleat unit and said back cleat unit comprising:

a retainer comprising a pair of intersecting members and a screw being coupled to and extending upwardly from said intersecting members, each of said intersecting members corresponding to said front cleat unit being positioned in an associated one of said first slots such that said retainer corresponding to said front cleat unit is inhibited from rotating, each of said intersecting members corresponding to said back cleat unit being positioned in an associated one of said second slots such that said retainer corresponding to said back cleat unit is inhibited from rotating, said screw having an un-threaded portion extending upwardly from said intersecting members and a threaded portion extending upwardly from said un-threaded portion;

a disk having a first surface and a second surface, said first surface having a ridge thereon, said ridge being continuous such that said ridge forms a closed loop, said ridge on said disk corresponding to said front cleat unit being positioned in said first channel, said ridge on said disk corresponding to said back cleat unit being positioned in said second channel, said ridge having an outer surface, said outer surface being concavely arcuate such that said ridge is rounded wherein said ridge on said disk corresponding to said front cleat unit is inhibited from being removed from said first channel and said ridge on said disk corresponding to said back cleat unit is inhibited from being removed from said second channel, said disk having an aperture extending through said first surface and said second surface, said aperture being centrally located on said disk, said screw on said retainer extending through said aperture having said disk being aligned with said un-threaded portion of said screw;

a bearing being positioned in said aperture in said disk, said bearing engaging said un-threaded portion of said screw such that said disk is rotatable about said screw;

a plurality of cleats, each of said cleats being coupled to said second surface of said disk, wherein each of said cleats is configured to engage the ground to enhance traction of said shoe, said cleats being spaced apart from each other and being distributed around said disk; and a fastener having a primary end, a secondary end and an outside surface extending between said primary end and said secondary end, said primary end having a well extending toward said secondary end, said well in said fastener having a bounding surface, said bounding surface of said well in said fastener being threaded to threadably engage said threaded portion of said screw thereby retaining said disk on said retainer, said outside surface tapering inwardly between said primary end and said secondary end such that said fastener has a truncated conical shape.

* * * * *